US005601105A

United States Patent [19]

Blen et al.

[11] Patent Number: 5,601,105

[45] Date of Patent: Feb. 11, 1997

[54] SELF-ERECTING TENT

[76] Inventors: Charles A. Blen, 12208 Buckskin Trail, Poway, Calif. 92064; Andrew Panno, Jr., 1061 Stonecrest La., Escondido, Calif. 92027

[21] Appl. No.: 629,007

[22] Filed: Apr. 8, 1996

[51] Int. Cl.[6] ..... E04H 15/40

[52] U.S. Cl. ..... 135/126; 135/134

[58] Field of Search ..... 135/124, 125, 135/126, 128, 134, 143

[56] References Cited

U.S. PATENT DOCUMENTS

| | | | |
|---|---|---|---|
| 3,960,161 | 6/1976 | Norman | 135/126 |
| 3,990,463 | 11/1976 | Norman . | |
| 4,858,634 | 8/1989 | McLeese . | |
| 5,137,044 | 8/1992 | Brady | 135/126 |
| 5,163,461 | 11/1992 | Ivanovich et al. . | |
| 5,249,592 | 10/1993 | Springer et al. | 135/126 |
| 5,337,772 | 8/1994 | Habchi . | |
| 5,385,165 | 1/1995 | Hazinski et al. . | |
| 5,396,917 | 3/1995 | Hazinski et al. . | |

OTHER PUBLICATIONS

Lifestyle Fascination, Mid–Summer 1995, p. 42.

*Primary Examiner*—Lanna Mai

[57] ABSTRACT

A self-erecting tent having three closed loop frame members that crisscross themselves along their respective left and right mid-points. The first closed loop frame member is threaded through the front sleeve and the rear arch sleeve of the tent body. The second closed loop frame member is threaded through the upper front arch sleeve and the rear floor sleeve of the tent body. The third closed loop frame member is threaded through the lower front arch sleeve and the rear floor sleeve. This produces a tent body having a lower front panel, an upper front panel, a central panel and a rear panel. A front door opening is formed in the lower front panel. The entire structure can be folded, twisted and bound into a flat circular package for transportation and storage. When released, the collapsed structure instantaneously springs back into a complete and fully erected tent.

5 Claims, 1 Drawing Sheet

SELF-ERECTING TENT

BACKGROUND OF THE INVENTION

The present invention relates to structures, such as tents, and more particularly to a tent, including a frame constructed of formable members, so that the tent is instantaneously self-erecting from its stored configuration and can be easily be restored to its storage configuration.

Several tents are known that relate to self-erecting structures. The Norman U.S. Pat. No. 3,960,161 is directed to a self-erecting having one single continuous loop wire member. In the Norman U.S. Pat. No. 3,990,463 he uses a single continuous loop of flexible material such as flat spring steel stock.

The McLeese U.S. Pat. No. 4,858,634 is discloses to a self-erecting tent structure that requires a base planar loop and either two or more extra loops for forming the upper portion of the tent. The Ivanovich et al U.S. Pat. No. 5,163,461 is directed to a self-erecting shelter that requires a single continuous loop steel wire member.

The Habchi U.S. Pat. No. 5,337,772 discloses a self-unfolding shelter having a framework of resilient wire in two separate closed loops.

The Hazinski et al U.S. Pat. No. 5,385,165 discloses a self-erecting hunting blind having a single continuous loop of wire. The tent separates at its center and collapses on both sides of the person or boat underneath it. The Hazinski et al U.S. Pat. No. 5,396,917 is also directed to a self-erecting pop-up tent. It utilizes a single wire loop frame.

It is an object of the invention to provide a novel self-erecting tent structure that has three closed loop frame members oriented in a specific manner to form a tent body having a lower front panel, an upper front panel, a central panel, and a rear panel.

It is also an object of the invention to provide a self-erecting tent structure that is simple and economical to manufacture.

It is another object of the invention to provide a novel self-erecting tent structure which is erectable from a storage configuration to the full erected configuration in a matter of seconds through instantaneously reformation of the frame members.

SUMMARY OF THE INVENTION

The novel self-erecting tent structure has an elongated oval type configuration in its erected state. One end of the oval shape is considered the front end and it has a door panel therein. There are three closed loop frame members that are threaded through sleeves in the tent body.

The first closed loop frame member has a front half that forms a front base portion that lays in a horizontal plane in its uncoiled state. It has a rear half that forms a rear arch portion that extends upwardly and rearwardly at an acute angle A from a horizontal plane. The front half and rear half of the first closed loop frame members meet each other at diametrically opposed first mid-points.

The second closed loop frame member has a front half that forms an upper front arch portion that extends upwardly and forwardly at an acute angle B from a horizontal plane. It has a rear half that forms a rear base portion that lays in a horizontal plane in its uncoiled state. The front half and rear half of the second closed loop frame members meet each other at diametrically opposed second mid-points.

The third closed loop frame member has a front half that forms a lower front arch portion that extends upwardly and forwardly at an acute angle C from a horizontal plane. Angle B is greater than angle C. The third closed loop frame member has a rear half that forms a rear base portion that lays in a horizontal plane in its uncoiled state adjacent the rear half of the second closed loop member. The front half and rear half of the third closed loop frame members meet each other at diametrically opposed third mid-points.

The tent body has a lower front panel, an upper front panel a central panel and a rear panel.

The lower front panel has a front door opening. It has an upper edge and a lower edge. A front floor sleeve is formed along the bottom edge and a lower front arch sleeve is formed along the top edge. The upper front panel has an upper edge and a lower edge. The lower front arch sleeve is formed along its lower edge and an upper front arch sleeve is formed along its top edge.

The central panel has a front edge and a rear edge. The upper front arch sleeve is formed along its front edge and a rear arch sleeve is formed along its rear edge.

The rear panel has a front edge and rear edge. The rear arch sleeve is formed along its front edge and a rear floor sleeve is formed along its rear edge.

The first closed loop frame member is threaded through the front floor sleeve and the rear arch sleeve. The second closed loop frame member is threaded through the upper front arch sleeve and the rear floor sleeve. The third closed loop frame member is threaded through the lower front arch sleeve and the rear floor sleeve.

DESCRIPTION OF THE PREFERRED EMBODIMENT

Figure 1:
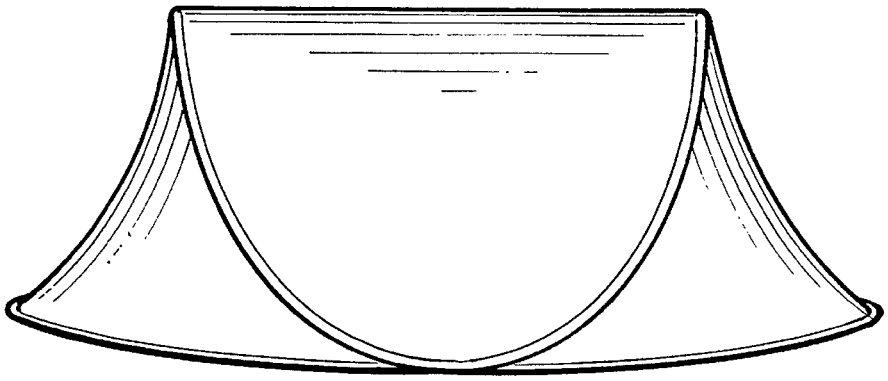
FIGURE 1 (PRIOR ART)
FIG. 1 is a side elevation view of a prior art self-erecting tent structure.
Figure 2:
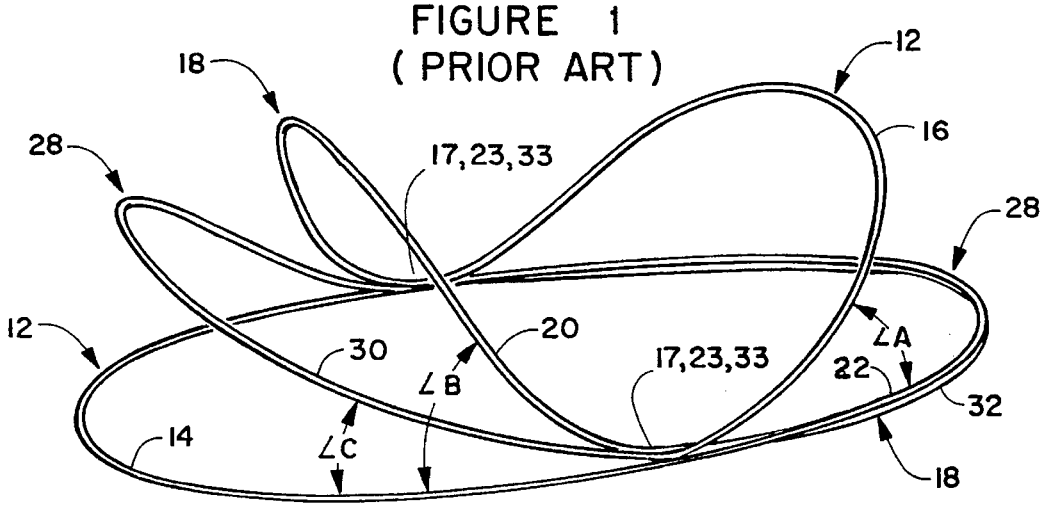
FIG. 2 is a schematic perspective view illustrating the manner in which the closed loop frame members form the desired configuration of the frame tent.
Figure 3:
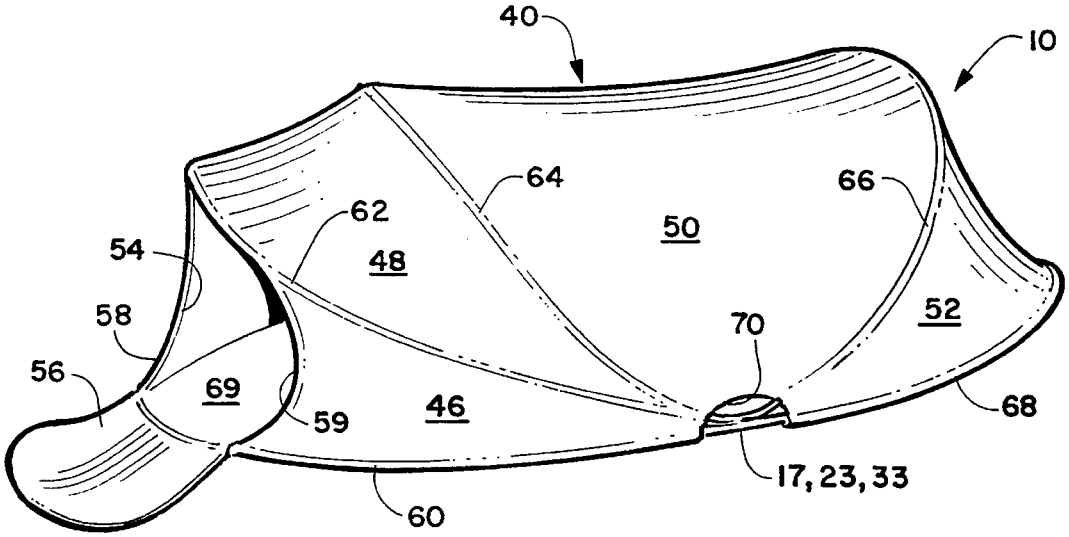
FIG. 3 is a right side perspective view of the novel-self-erecting tent structure.

FIG. 1 shows a typical prior art self-erecting tent structure. FIGS. 2 and 3 will be referred to in describing the novel structure of the inventor's self-erecting tent structure. The self-erecting tent is generally designated numeral 10.

In FIG. 2, a first closed loop frame member 12 has a front base portion 14 and a rear arch portion 16 it has diametrically opposed mid-points 17. A second closed loop frame member 18 has an upper front arch portion 20 and a rear base portion 22. It has diametrically opposed mid-points 23.

A third closed loop frame member 28 has a lower front arch portion 30 and a rear base portion 32. It has diametrically opposed third mid-points 33. Rear arch portion 16 extends upwardly from the horizontal plane at an acute angle A. Upper front arch portion 20 extends upwardly at an acute angle B from the horizontal plane. Lower front arch portion 30 extends upwardly at an acute angle C from the horizontal plane.

The closed loop frame members can be constructed of material suitable for forming a framework structure which would have high elasticity and/or resilience. Such characteristics may also be combined with high tensile and/or compressive strength. Examples of suitable materials are spring steel, fiber composites such as graphite and highly flexible plastics.

Tent body 40 has a front half and a rear half. The tent body has a lower front panel 46, an upper front panel 48, a central panel 50 and a rear panel 52. A front door opening 54 is formed in lower front panel 46 and a door panel 56 is detachably secured therein by zippers 58 and 59.

A front floor sleeve 60 is formed along the bottom edge of lower front panel 46. A lower front arch sleeve 62 is formed adjacent the top edge of lower front panel 46 and the bottom edge of upper front panel 48. An upper front arch sleeve 64 is formed adjacent the top edge of upper front panel 48 and the front edge of central panel 50. Rear arch sleeve 66 is formed adjacent the rear edge of central panel 50 and the top edge of rear panel 52. A rear floor sleeve 68 is formed adjacent rear panel 52. A cutout portion 70 is formed in each of the left and right sides of the tent where the three closed loop frame members crisscross each other. The tent has a floor 69.

First closed loop frame member 12 is threaded through front floor sleeve 60 and rear arch sleeve 66. Second closed loop frame member 18 is threaded through upper front arch sleeve 62 and rear floor sleeve 68. Third closed loop frame member 28 is threaded through lower front arch sleeve 62 and rear floor sleeve 68.

It is important to note that the features in the self erecting tent provide for a structure which can be placed in the stored position and instantaneously form a self-erecting tent having a complete base portion for moving into. This may be critical and in instances where one is faced with adverse weather, or darkness or because of a handicap or the like, would be unable to erect a tent of the normal type of structure. The manner of construction of this tent allows instant self-erecting and provides for very easy and simple manual steps for reconfiguration of the tent to the stored configuration.

What is claimed is:

1. A self-erecting tent structure comprising:

a continuous resilient first closed loop frame member; it has a front half that forms a front base portion that lays in a horizontal plane in its uncoiled state; it has a rear half that forms a rear arch portion that extends upwardly and rearwardly at a first acute angle from a horizontal plane; said front half and said rear half of said first closed loop meet each other at diametrically opposed first mid-point;

a continuous resilient second closed loop frame member; it has a front half that forms an upper front arch portion that extends upwardly and rearwardly at a second acute angle from a horizontal plane; it has a rear half that forms a rear base portion that lays in a horizontal plane in its uncoiled state; said front half and rear half of said second closed loop meet each other at diametrically opposed second mid-point;

a continuous resilient third closed loop frame member; it has a front half that forms a lower front arch portion that extends upwardly and forwardly at a third acute angle from a horizontal plane; said second angle is greater than said third angle; it has rear half that forms a rear base portion that lays in a horizontal plane in its uncoiled state adjacent the rear half of said second closed loop member; said front half and said rear half of said third closed loop meet each other at diametrically opposed third mid-points;

a tent body having a lower front panel, and upper front panel, a central panel and a rear panel;

said lower front panel having a front door opening; it has an upper edge and a lower edge; a front floor sleeve is formed along said bottom edge and a lower front arch sleeve is formed along its top edge;

said upper front panel having an upper edge and a lower edge; said lower front arch sleeve is formed along its lower edge and an upper front arch sleeve is formed along its top edge;

said central panel having a front edge and a rear edge; said upper front arch sleeve is formed along its front edge and a rear arch sleeve is formed along its rear edge;

said rear panel having a front edge and a rear edge; said rear arch sleeve is formed along its front edge and a rear floor sleeve is formed along its rear edge;

said first closed loop frame member is threaded through said front floor sleeve and said rear arch sleeve;

said second closed loop frame member is threaded through said upper front arch sleeve and said rear floor sleeve; and said third closed loop frame member is threaded through said lower front arch sleeve and said rear floor sleeve.

2. A self-erecting tent structure as recited in claim 1 further comprising a floor panel having an outer edge; said front floor sleeve and said rear floor sleeve are formed along said outer edge.

3. A self-erecting tent structure as recited in claim 1 further comprising a front door and means for attaching it in said front door opening.

4. A self-erecting tent structure as recited in claim 1 wherein said three closed loop frame members are made of spring steel.

5. A self-erecting tent structure as recited in claim 1 further comprising a cutout portion in each of the left and right sides of the tent where the three closed loop frame members crisscross each other.

* * * * *